US007913750B2

(12) United States Patent
Huang et al.

(10) Patent No.: US 7,913,750 B2
(45) Date of Patent: Mar. 29, 2011

(54) LOUVERED AIR CENTER WITH VORTEX GENERATING EXTENSIONS FOR COMPACT HEAT EXCHANGER

(75) Inventors: Lin-Jie Huang, East Amherst, NY (US); Laurent Art, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 242 days.

(21) Appl. No.: 12/221,706

(22) Filed: Aug. 6, 2008

(65) Prior Publication Data

US 2009/0173480 A1 Jul. 9, 2009

Related U.S. Application Data

(60) Provisional application No. 61/019,978, filed on Jan. 9, 2008.

(51) Int. Cl.
*F28D 1/02* (2006.01)
*F28F 1/42* (2006.01)

(52) U.S. Cl. ..... 165/152; 165/109.1; 165/179

(58) Field of Classification Search ..... 165/177, 165/148, 153, 176, 151, 152, 109.1; 29/890.053
See application file for complete search history.

(56) References Cited

U.S. PATENT DOCUMENTS

| | | | | |
|---|---|---|---|---|
| 4,470,452 | A * | 9/1984 | Rhodes | 165/153 |
| 5,185,925 | A * | 2/1993 | Ryan et al. | 29/890.049 |
| 5,890,288 | A * | 4/1999 | Rhodes et al. | 29/890.053 |
| 6,510,870 | B1 * | 1/2003 | Valaszkai et al. | 138/38 |
| 7,011,150 | B2 * | 3/2006 | Komatsubara et al. | 165/177 |
| 7,182,128 | B2 * | 2/2007 | Yu et al. | 165/177 |
| 2007/0012430 | A1 * | 1/2007 | Duke et al. | 165/109.1 |

* cited by examiner

*Primary Examiner* — Tho V Duong
(74) *Attorney, Agent, or Firm* — Patrick M. Griffin

(57) ABSTRACT

A heat exchanger assembly includes an upper and lower manifold. A plurality of tubes have flat sides and extend between the upper and lower manifold. A plurality of fins extend back and forth between and along the flat sides of adjacent ones of the tubes forming a continuous serpentine path. Each of the fins include a plurality of legs that extend between the adjacent ones of the tubes. A plurality of end portions extend along the tube sides so that adjacent legs are connected by one of the end portions to define a tube space between said adjacent legs. Each of the tubes include a plurality of spaced protrusions extending outwardly from both of the flat sides of said tubes into the tube space between the legs. A plurality of spaced projections extend inwardly from said end portions of said fins between said legs for interrupting air flow.

1 Claim, 4 Drawing Sheets

LOUVERED AIR CENTER WITH VORTEX GENERATING EXTENSIONS FOR COMPACT HEAT EXCHANGER

CROSS REFERENCE TO RELATED APPLICATION

This application claims the benefit of U.S. Provisional Patent Application Ser. No. 61/019,978 for a LOUVERED AIR CENTER WITH VORTEX GENERATING EXTENSIONS FOR COMPACT HEAT EXCHANGER, filed on Jan. 9, 2008, which is hereby incorporated by reference in its entirety.

BACKGROUND OF THE INVENTION

1. Field of the Invention

A heat exchanger assembly, and more specifically, an assembly including louvered fins.

2. Description of the Prior Art

Louvered air performance is critical to compact heat exchangers (such as radiator, heater, condenser, and evaporator) total heat transfer rate for automotive and STAC applications. A typical heat exchanger with a louvered air design includes a plurality of tubes extending parallel to one another and a fin extending back and forth between each pair of adjacent tubes. Typically, each fin defines at least one louvered portion having a plurality of louvers extending parallel to one another. The fin has legs extending between the tubes and a end portion interconnecting two adjacent legs to define an tube space.

Due to the manufacturing limitation, a typical height of the louvered portion is about 75%-85% of the total air center height, or total fin height. This manufacturing limitation has led to "un-louvered regions" in both end of the air center. In these two regions, the airflow is un-disrupted by the louver, airflow velocity is high, and the thermal boundary layers are thick.

US Application 2007/0012430 discloses an upper manifold extending along an upper centerline and a lower manifold extending along a lower centerline. The manifolds are spaced form one another with the centerlines being parallel to each other. The upper manifold defines a plurality of upper tube slots being spaced along the upper centerline. The lower manifold define a plurality of lower tube slots being spaced along the lower centerline and aligned with the upper tube slots.

A plurality of tubes have flat sides and extend between ends thereof in the upper and lower tube slots and are parallel and spaced from one another. A plurality of fins each extend back and forth between and along the flat sides of the adjacent ones of tubes forming a continuous serpentine path. Each of the fins include a plurality of legs that extend between the tubes and a plurality of end portions that extend along the tube sides adjacent ones of the tubes to define the serpentine path. The adjacent legs are connected by one of the end portions along one tube and are open to the opposite adjacent tube to define a tube space between the adjacent legs along the flat sides of the tubes.

Although the current assemblies are sufficient for their intended purposes, there remains a need for a louvered air center heat exchanger that improves heat transfer.

SUMMARY OF THE INVENTION

The invention provides for a plurality of spaced projections extending inwardly from the end portions of the fins between the legs for interrupting air flow. The invention disrupts the airflow at both ends of the tube space to the same level as that of the air in the louvered region of the tube space thereby breaking airflow and thermal boundary layers and improving total heat transfer of the heat exchanger.

BRIEF DESCRIPTION OF THE DRAWINGS

Advantages of the present invention will be readily appreciated as the same becomes better understood by reference to the following detailed description and the accompanying drawings that set forth an exemplary embodiment wherein.

DETAILED DESCRIPTION OF THE EXEMPLARY EMBODIMENTS

Figure 1:
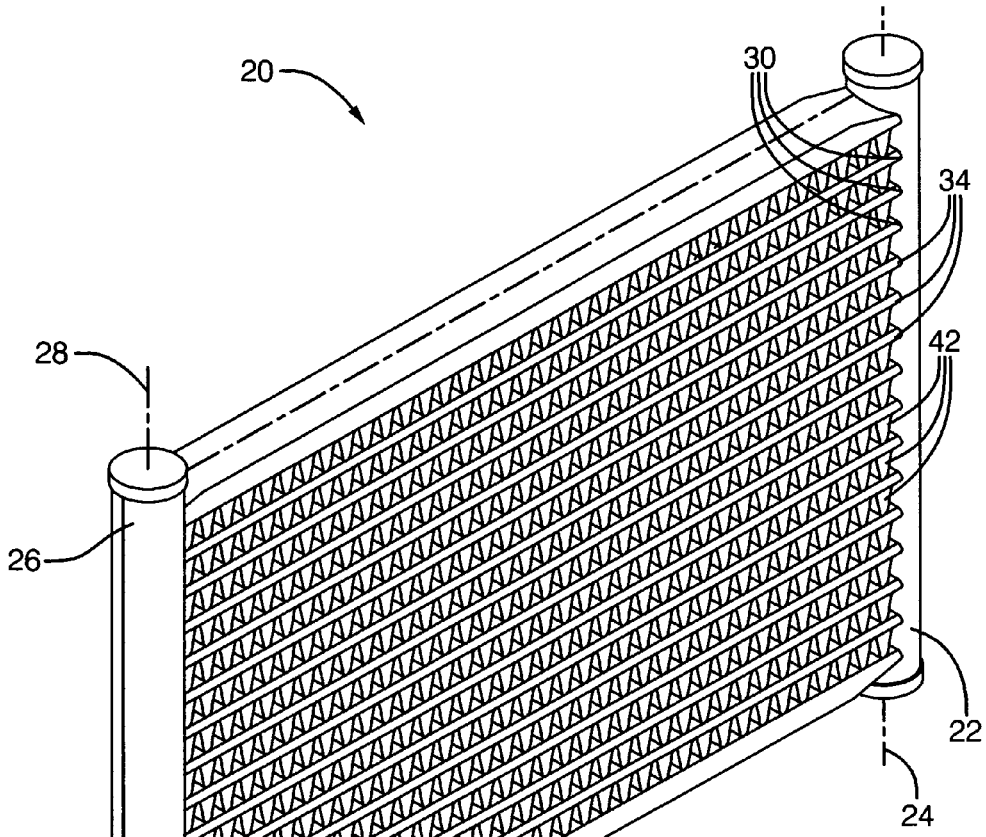
FIG. 1 is a perspective view of a heat exchanger assembly.
Figure 2:
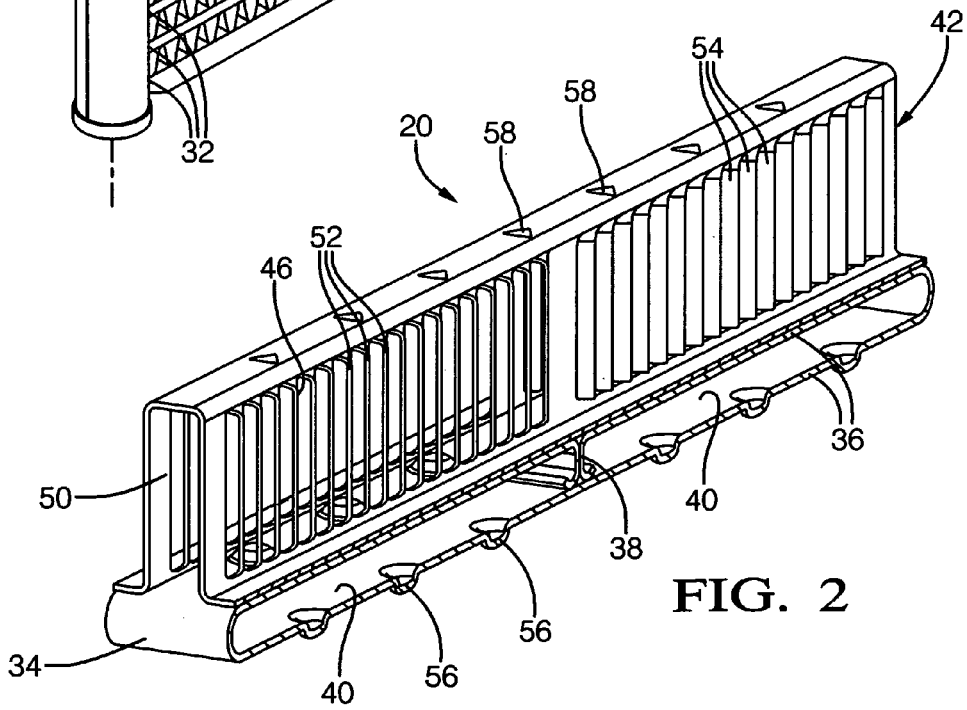
FIG. 2 is a perspective view of a portion of the heat exchanger assembly of FIG. 1.

Referring to the Figures, wherein like numerals indicate corresponding parts throughout the several views, a heat exchanger assembly 20 is generally shown in FIGS. 1 and 2.

An upper manifold 22 extends along an upper centerline 24 and a lower manifold 26 extends along a lower centerline 28. The manifolds 22, 26 are spaced form one another with the centerlines 24, 28 being parallel to each other. The upper manifold 22 defines a plurality of upper tube slots 30 which are equal distantly spaced along the upper centerline 24. The lower manifold 26 defines a plurality of lower tube slots 32 which are equal distantly spaced along the lower centerline 28 and aligned with the upper tube slots 30.

Figure 3:
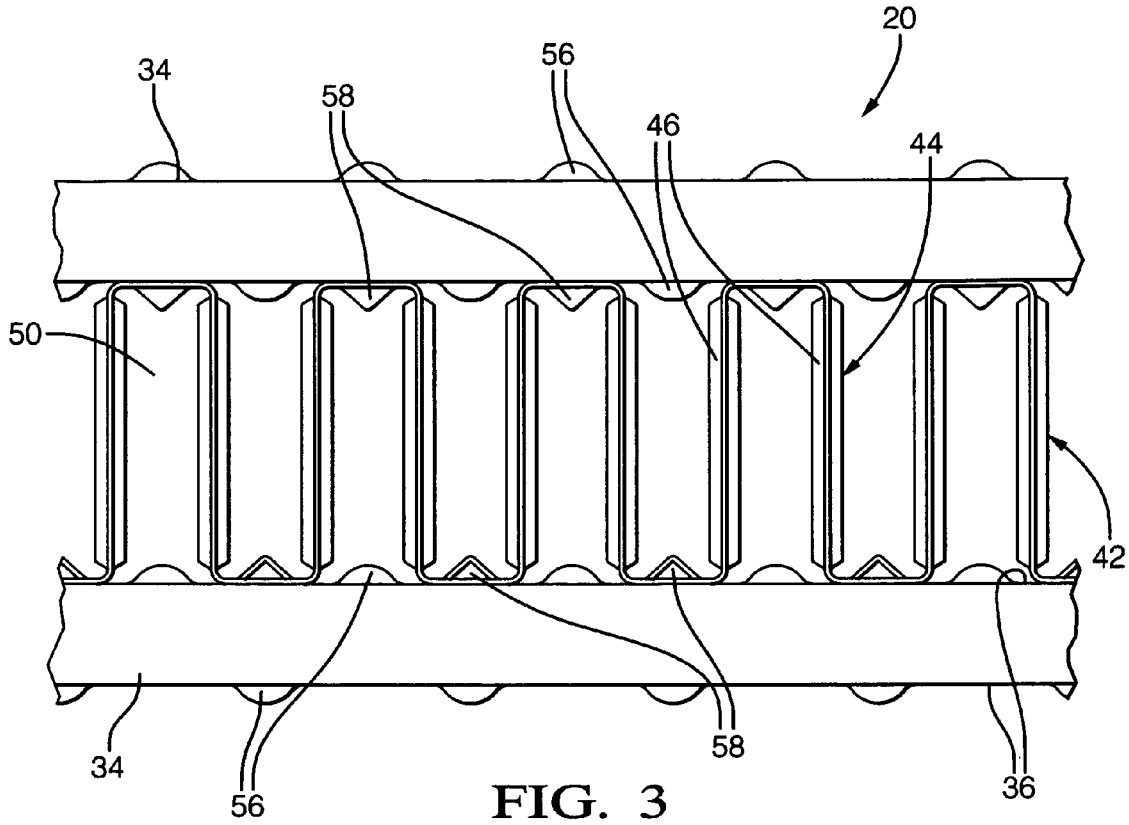
FIG. 3 is a cross sectional view of the embodiment of FIG. 2 illustrating projections on the tube; and, FIG. 4 is a graph of the air velocity through the channel of FIG. 3 versus the center height.

A plurality of tubes 34 having flat sides 36 extend between the ends thereof in the upper and lower tube slots 30, 32 and are parallel and spaced from one another. The tube sides 36 are not limited to being flat. For manufacturing purposes, the tube sides 36 may be extruded. Each of the tubes 34 include a partition 38 that extends between the ends in the slots 30, 32 to define a pair of fluid passages 40 in each of the tubes 34 for conveying refrigerant. A plurality of fins 42, generally indicated in FIGS. 2 and 3, extend back and forth between and along the flat sides 36 of adjacent ones of the tubes 34 in a continuous serpentine path 44, generally indicated in FIG. 3. Each of the fins 42 include a plurality of legs 46 that extend between the adjacent ones of the tubes 34. A plurality of end portions 48 extend along the tube sides 36 of the adjacent ones of the tubes 34 to define the serpentine path 44. The adjacent legs 46 are connected by one of the end portions 48 along one tube 34 and are open to the opposite adjacent tube 34 to define a tube space 50 between the adjacent legs 46 along the flat sides 36 of the tubes 34.

Each of the legs 46 include at least one set of louvers 52, 54 that extend diagonally outwardly from the legs 46. The Louvers include a set of first louvers 52 that extend between adjacent tubes 34 on one side of the partition 38 and are angled away from the partition 38. A set of second louvers 54 extend between the adjacent tubes 34 on the other side of the partition 38 and are angled in the opposite direction from the partition 38 for directing air in opposite directions from the partition 38 of each of the tube 34. The legs may define more than two sets of louvers. Each of the tubes 34 include a plurality of spaced protrusions 56 extending outwardly from the flat sides 36 of the tubes 34 into the tube space 50 between the legs 46 for interrupting air flow through the tube space 50. The protrusions 56 protrude from both sides of each of the tubes 34 for disposition in the tube space 50 between the legs 46.

Figure 4:
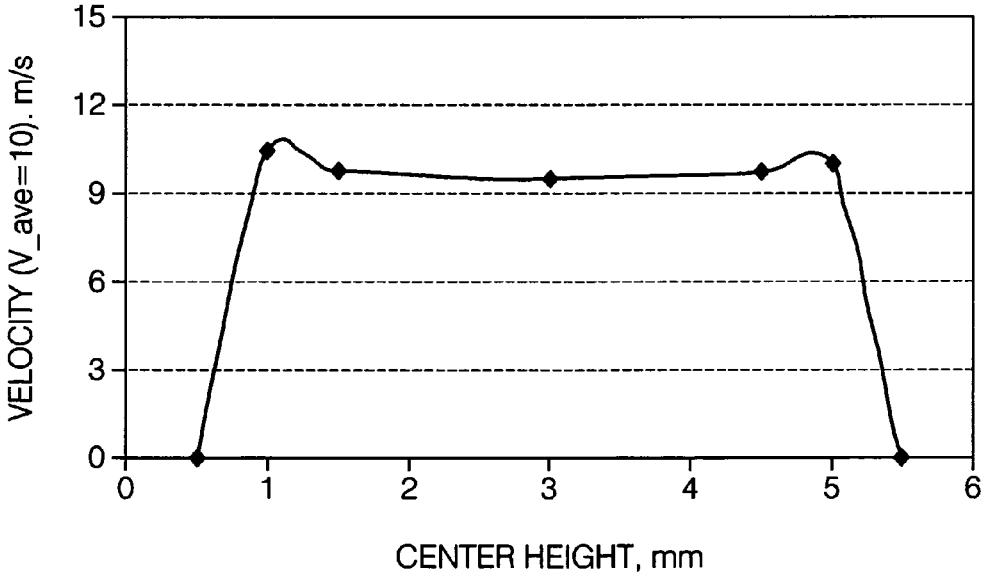
Figure 5:
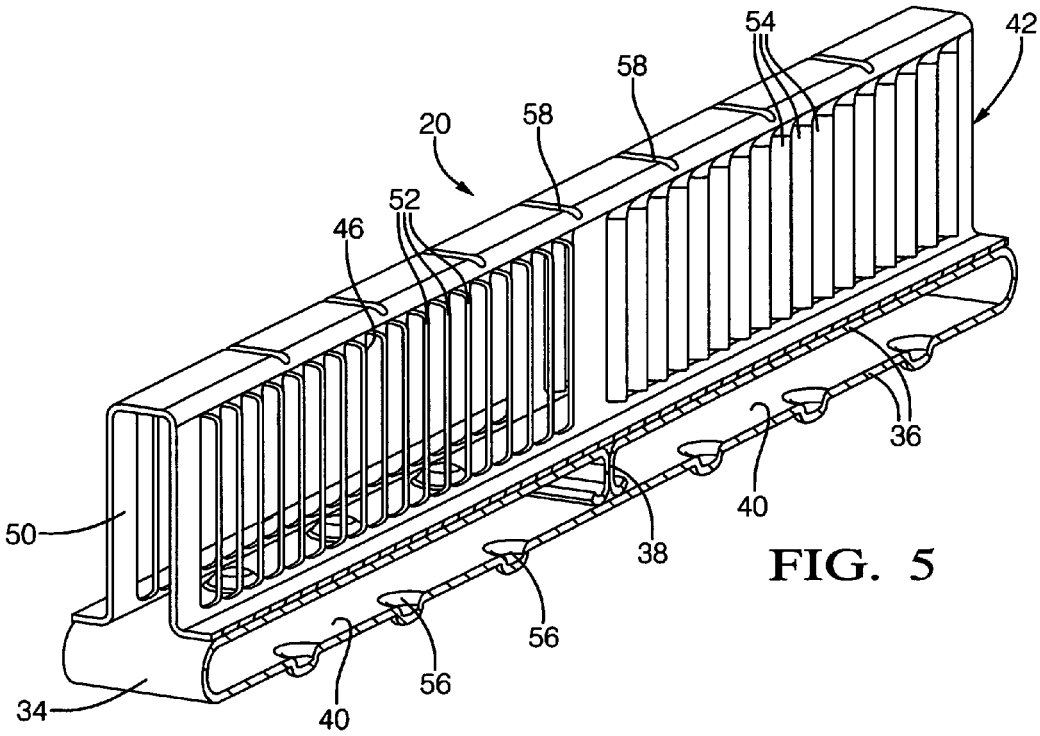
FIG. 5 is a perspective view of a portion of the heat exchanger of a second embodiment.
Figure 6:
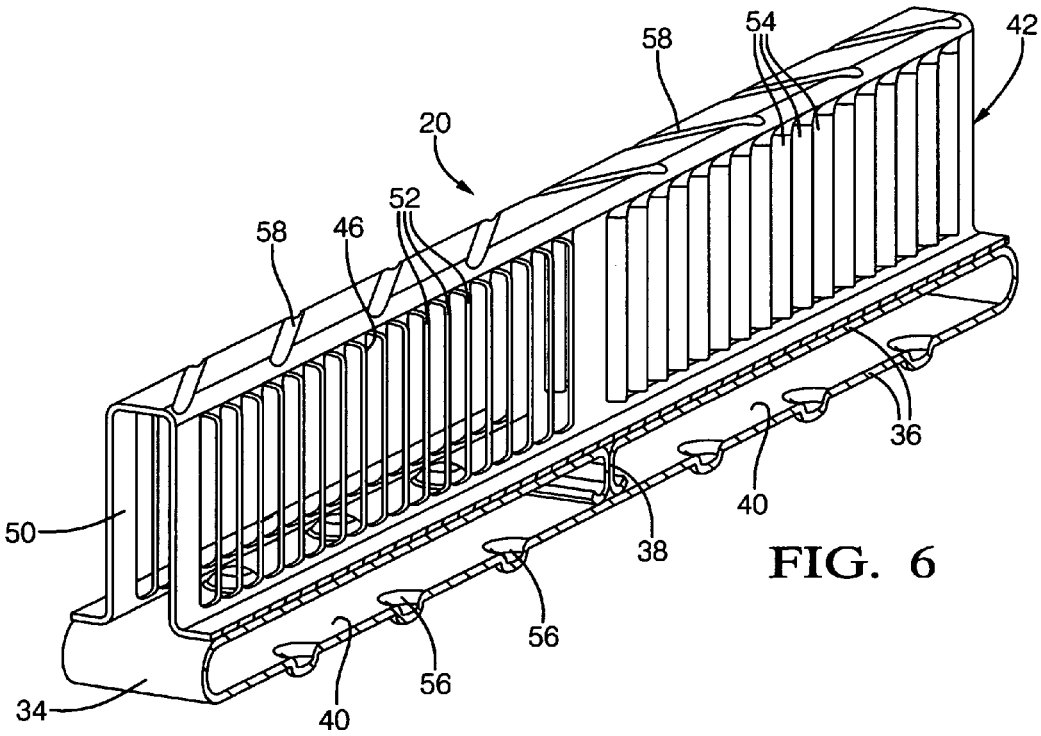
FIG. 6 is a perspective view of a portion of the heat exchanger of a third embodiment.
Figure 7:
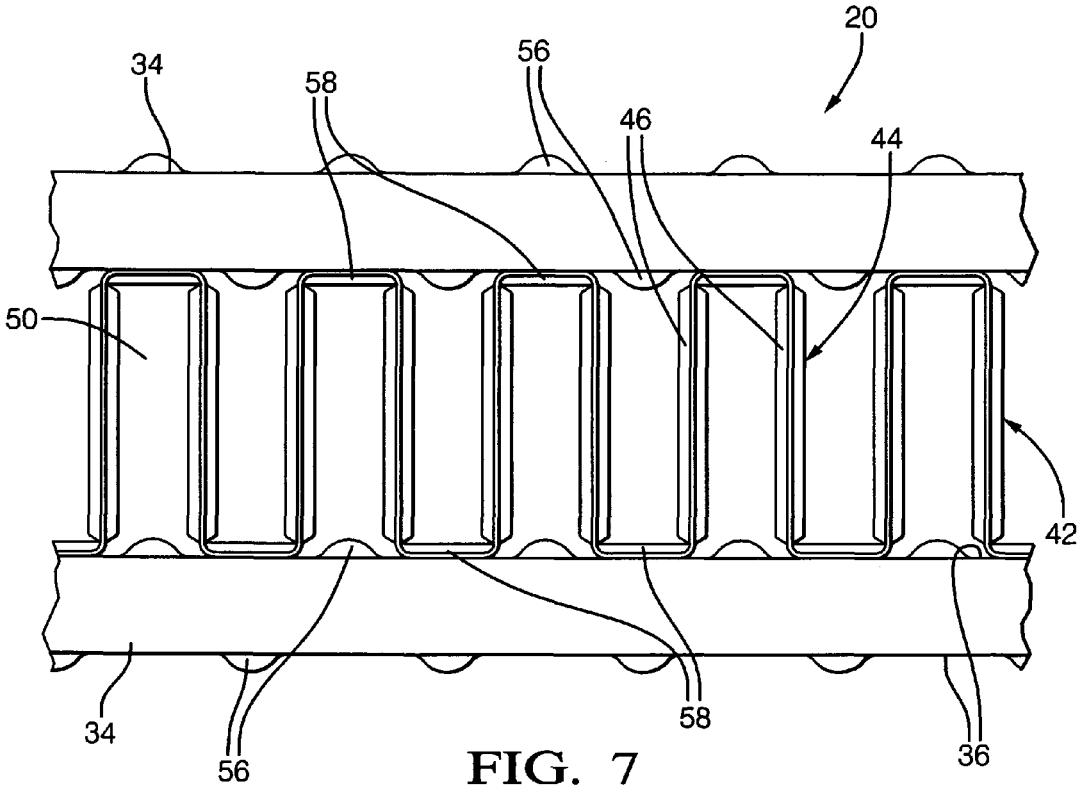
FIG. 7 is a cross sectional view of the embodiments of FIGS. 5 and 6 illustrating projections on the tube.

A plurality of spaced projections 58 extend inwardly from the end portions 48 of the fins 42 between the legs 46 for interrupting air flow. The projections 58 may have a conical shape, as shown in FIGS. 1-4. They may also extend diagonally across the end portions 48 and have a cylindrical shape, as shown in FIG. 5. Further, the projections may extend diagonally across the end portions 48 to align with each set of louvers 52, 54, as shown in FIG. 7.

The velocity of the air through the tube space 50 varies along the center height of the tube space 50. FIG. 4 shows the air velocity versus the center height within one of the tube spaces 50. The protrusions 56 and projections 58 disrupt the airflow and reduce the velocity in each of the tube spaces 50. The increased uniformity of air velocities through each tube space 50 improve the heat transfer rate by as much as 10% with a corresponding 15% pressure penalty.

It is to be understood that "upper" and "lower" as used in the present application are arbitrary, inasmuch as a heat exchanger in accordance with the present invention can be oriented in different directions. Therefore, "upper" and "lower" should be understood to be used with reference to the orientation of the manifolds and tubes as shown in the drawings herein, and is not limiting the orientation of the manifolds or tubes in actual use.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger assembly comprising:

an upper manifold extending along an upper centerline;

a lower manifold extending along a lower centerline;

said manifolds being spaced form one another with said centerlines being parallel to each other;

said upper manifold defining a plurality of upper tube slots being spaced along said upper centerline;

said lower manifold defining a plurality of lower tube slots being spaced along said lower centerline and aligned with said upper tube slots;

a plurality of tubes having tube sides and extending between ends thereof in said upper and lower tube slots and parallel and spaced from one another;

a plurality of fins each extending back and forth between and along said flat sides of adjacent ones of said tubes in a continuous serpentine path;

each of said fins including a plurality of legs extending between said adjacent ones of said tubes and a plurality of end portions extending along said tube sides said adjacent ones of said tubes to define said serpentine path so that adjacent legs are connected by one of said end portions along one said tube and are open to the opposite adjacent tube to define a tube space between said adjacent legs along said tube sides of said tubes; and a plurality of spaced projections extending inwardly from said end portions of said fins between said legs, wherein said tube sides are flat and said tubes include a plurality of spaced protrusions extending outwardly from said flat tube sides of said tubes into said tube space between said legs, and wherein said projections and said protrusions are axially aligned in such a matter that air flow through said tube space is disrupted by said projections cooperating with said protrusion to break the airflow and thermal boundary layers, thereby improving total heat transfer.

* * * * *